United States Patent [19]

Goldfarb

[11] Patent Number: 4,945,643

[45] Date of Patent: Aug. 7, 1990

[54] AMUSEMENT APPARATUS FOR DRAWING A DISTORTED CARICATURE BY TRACING AN ORIGINAL PHOTOGRAPH OR THE LIKE

[76] Inventor: Adolph E. Goldfarb, 1432 SE. Wind Cir., Westlake Village, Calif. 91361

[21] Appl. No.: 309,396

[22] Filed: Feb. 10, 1989

Related U.S. Application Data

[63] Continuation-in-part of Ser. No. 150,028, Jan. 29, 1988, Pat. No. 4,825,556.

[51] Int. Cl.[5] ..... B43L 13/10

[52] U.S. Cl. ..... 33/23.04; 33/23.02

[58] Field of Search ..... 33/23.01, 23.02, 23.04, 33/23.09, 23.11, 27.67

[56] References Cited

U.S. PATENT DOCUMENTS

| | | | |
|---|---|---|---|
| D. 141,675 | 6/1945 | Bolter | 33/23.04 |
| 1,320,321 | 10/1919 | Crowley, Jr. | 33/23.04 |
| 1,997,287 | 4/1935 | Adler | 33/23.02 |
| 2,021,931 | 11/1935 | Bockius | 33/23.02 |
| 2,823,456 | 2/1958 | Valois | 33/23.02 |
| 2,885,786 | 5/1959 | Badgett | 33/23.01 |
| 2,886,891 | 5/1959 | Keller | 33/23.04 |
| 3,101,548 | 8/1963 | Morin | 33/23.02 |
| 3,359,641 | 12/1967 | Gregston | 33/23.04 |
| 3,559,290 | 2/1971 | Glass et al. | 33/23.01 |

FOREIGN PATENT DOCUMENTS

| | | | |
|---|---|---|---|
| 91580 | 4/1897 | Fed. Rep. of Germany | 33/23.04 |
| 818261 | 10/1951 | Fed. Rep. of Germany | 33/23.02 |
| 0400706 | 11/1933 | United Kingdom | 33/23.02 |

*Primary Examiner*—Thomas B. Will

*Attorney, Agent, or Firm*—Ashen, Martin Seldon Lippman & Seillieri

[57] ABSTRACT

This very simple apparatus enlarges in one direction, and copies without enlargement in an orthogonal direction. A tracing arm has a tracing stylus at one point, a drawing-implement holder at another point, and a longitudinal track along another part of the arm. The track engages a pivot that in effect resolves all tracing motions into radial and rotary components. Radial components are traced without change of size; but rotary components are enlarged by a factor that depends on the ratio of radii from the pivot to the stylus and implement holder respectively. A photo or other picture to be traced is held in a retainer on a platform; and drawing paper is held on an easel. The retainer and easel are sized in relation to their distances from the tracing-arm pivot to limit the overall angular range of operation to significantly less than sixty degrees; this limitation makes the rotary components very nearly straight-line components, so that the enlargement direction appears roughly to be one straight-line direction that is perpendicular to the nonenlargement direction. The platform is rotatably mounted and has detents so that a user can place a photo in any of a multiplicity of angular orientations relative to the enlargement direction.

8 Claims, 3 Drawing Sheets

AMUSEMENT APPARATUS FOR DRAWING A DISTORTED CARICATURE BY TRACING AN ORIGINAL PHOTOGRAPH OR THE LIKE

RELATED APPLICATION

This is a continuation-in-part of my U.S. patent application Ser. No. 150,028, filed Jan. 29, 1988, and issued May 2, 1989, as U.S. Pat. No. 4,825,556.

BACKGROUND

1. Field of the Invention

This invention relates generally to amusement devices and toy drawing apparatus; and more particularly to an amusement apparatus for drawing a distorted caricature by tracing an original photograph or the like.

2. Prior Art

Many simple devices such as pantographs have been introduced for tracing pictures with an enlargement. (For the sake of simplicity of expression, as used in this document the word "enlargement" is to be understood as encompassing enlargement by a factor less than unity—i.e., reduction.)

In such devices a design objective is generally to provide roughly equal enlargement in all directions. Such an arrangement preserves shapes from the original picture in the tracing.

One prior device, however, did provide selectively different enlargement factors in different directions, thereby introducing distortion into the traced shapes. That device was sold commercially under the trademark "Krazy Kopier" and was essentially a parallelogram pantograph.

The four bars of the parallelogram included one bar that was generally disposed fore-and-aft along the left edge of the apparatus, and that extended rearward beyond the parallelogram to a fixed pivot. The pivot constrained the two parallelogram corners along that left-hand bar to rotate about the fixed pivot.

The first parallelogram corner—that is, the corner closest to the fixed pivot—could do no more than rotate, with a fixed and relatively small radius, about the pivot. The radius to that first corner was roughly half the length of the left-hand bar.

The opposite corner of the parallelogram, by contrast, was essentially free to swing in two dimensions over a very large range of positions. A tracing stylus was mounted to that opposite corner, and used to trace an original picture.

Drawing implements were shiftably mounted along a cross-arm or drawing arm of the parallelogram. That arm was attached to the "first corner" mentioned above, and extended to the right across the apparatus. The cross-arm was thus mounted halfway out the pantograph, along one axis of the system, from the pivot to the stylus.

A drawing implement mounted to the parallelogram at a point halfway from the pivot point to the tracing stylus—along both directions of the pantograph—would produce a drawing very similar in shape to the original traced picture, but about half of the overall size. This was the case for a drawing implement mounted at a point halfway across the cross-arm.

An implement mounted on the cross-arm but nearer to the above-mentioned "first" corner would produce a drawing of nearly the same size in the lateral direction, but much smaller in the fore-to-aft direction. The opposite effect was created by a drawing implement mounted at a "second" corner of the parallelogram, near the right end of the cross-arm: the drawing produced would be nearly the same size in the lateral direction, but much larger fore-to-aft.

Implements at intermediate positions would produce intermediate effects. Thus the "Krazy Kopier" device was capable of a variety of visual effects, but required seven moving parts (four bars, and three sliding pen holders secured along the cross-bar) and five smoothly operating pivots—that is, pivots that operated during making of a tracing, and therefore were required to operate smoothly.

Furthermore, the variety of visual effects was limited in one regard. The "Krazy Kopier" device had a fixed holder for positioning the original picture. This holder included corner slots for retaining the picture.

Children or other users who used the fixed holder were limited to lengthening or foreshortening distortions that were aligned with the fore-to-aft (i.e., top-to-bottom) direction of the picture,. Therefore the prior art did not provide a very economical and simple tracing device, or a tracing device capable of introducing a distortion selectively in any arbitrary orientation relative to the picture.

SUMMARY OF THE DISCLOSURE

My invention is an amusement apparatus. It is for use with a drawing medium and drawing implement to draw a distorted caricature of an original picture, by tracing of the original picture.

The apparatus includes a base. It also includes a platform, supported from the base for rotation about a platform-rotation axis, for carrying such a picture.

The apparatus further includes a drawing easel for holding such a drawing medium. The easel too is supported from the base.

In addition the apparatus includes a drawing-implement arm. This arm has three principal features:

At one location along the arm, the arm has a motion-imparting stylus. The stylus is disposed generally adjacent to the platform, for manual manipulation by a user to trace a picture—when such a picture is in place on the platform.

At another location along the arm, the arm has a drawing-implement holder. The holder is disposed generally adjacent to the easel, for marking by such a drawing implement (when in place in the holder) on a drawing medium (when in place on the easel).

At a third location along the arm, the arm also has a longitudinal track.

The amusement apparatus also must have some means for defining an arm-pivot axis. For purposes of breadth and generality of expression in describing my invention, I shall refer to these means as the "arm-pivot means."

The arm-pivot means are supported from the base. The pivot axis which they define is fixed relative to the base; and it is for engaging the track so that motions of the stylus are resolved into radial and rotary components of motion relative to the arm-pivot axis.

Radial components of motion of the stylus are produced by relative sliding motion of the arm-pivot means along the track. In turn, these radial components of stylus motion produce radial components of motion of the drawing-implement holder. The radial components of implement holder motion are substantially equal to the radial components of stylus motion.

Rotary components of motion of the stylus also produce corresponding rotary components of motion of the drawing-implement holder. This correspondence is different, however, in that the rotary holder-motion components are not equal to the rotary stylus-motion components.

Rather, the rotary holder-motion components are larger—by an enlargement factor that is determined by the relative distances of the stylus and the drawing-implement holder from the arm-pivot axis. Thus the apparatus produces a caricature of the original picture that is distorted by being enlarged with respect to only the rotary components of tracing motion.

The apparatus also has a retainer, carried on the platform, for retaining such a picture on the platform. Finally, the apparatus must have some means for positioning the platform in any user-selected one of a multiplicity of angular orientations.

For generality as before, I shall call these means the "platform-positioning means." The platform-positioning means are manually operable; and they position not only the platform itself but also the retainer—and the original picture thereon—in any of the multiplicity of angular orientations.

Accordingly the user can select and set a desired particular angular orientation of the original picture relative to the radial components of motion of the stylus. In this way the user can select a desired relationship between (1) the directions in which enlargement occurs and (2) any particular desired features of the original picture.

This apparatus is improved over the prior art not only by this systematic selectability of enlargement direction relative to the picture, but also by a great advancement in economy and simplicity. This invention has only two moving parts.

Of these two, one (the rotatable platform) need not move smoothly. The platform is not operated during the process of making a tracing, but only before starting when the user wishes to rotate the picture relative to the enlargement direction.

The apparatus also has only two pivot points—including one sliding pivot, the arm-pivot means. What is more, neither of these is required to pivot very precisely; and only one is required to operate smoothly, since the platform need not move smoothly.

The foregoing may be a description of my invention in its broadest or most general form. As will be appreciated, however, for greatest enjoyment of the benefits of my invention I prefer to incorporate certain additional features or characteristics.

For example, I prefer to make the size of the retainer or the size of the easel, or both, relative to the distance between the retainer or easel and the arm-pivot axis, such as to limit the rotary components of motion of the stylus to a full range of substantially less than thirty degrees in either direction from the system centerline. (By the "system centerline" I mean to refer to the centerline of the retainer or easel, as the case may be.)

When this condition is observed, the motions of the stylus are resolved very approximately into rectilinear components that are respectively parallel and perpendicular to the centerline. In this way the user can orient features of the original picture in any desired direction relative to a roughly rectilinear axis along which enlargement occurs. This arrangement simplifies the apparent operation of the device, as perceived by children or other relatively unsophisticated users of the apparatus.

I also prefer that the positioning means include manually releasable detent means for holding the platform against rotation. Here too, the result is to present a device of great apparent simplicity, while actually calling attention to the added versatility provided by the rotatable picture platform.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figure 1:
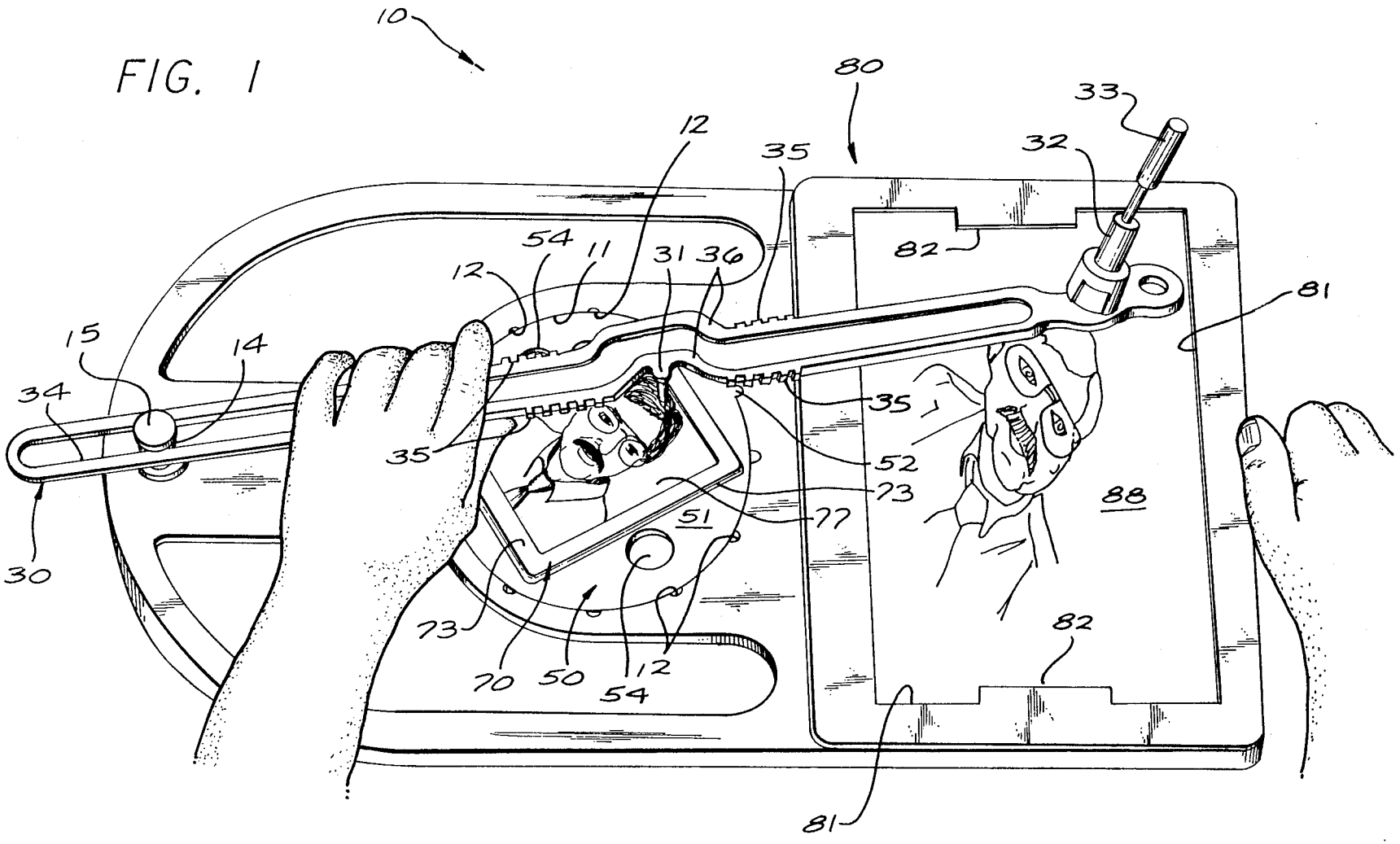
FIG. 1 is a perspective view of a preferred embodiment of my invention. The apparatus is shown in use to make a distorted caricature by tracing from a photograph of a person.
Figure 2:
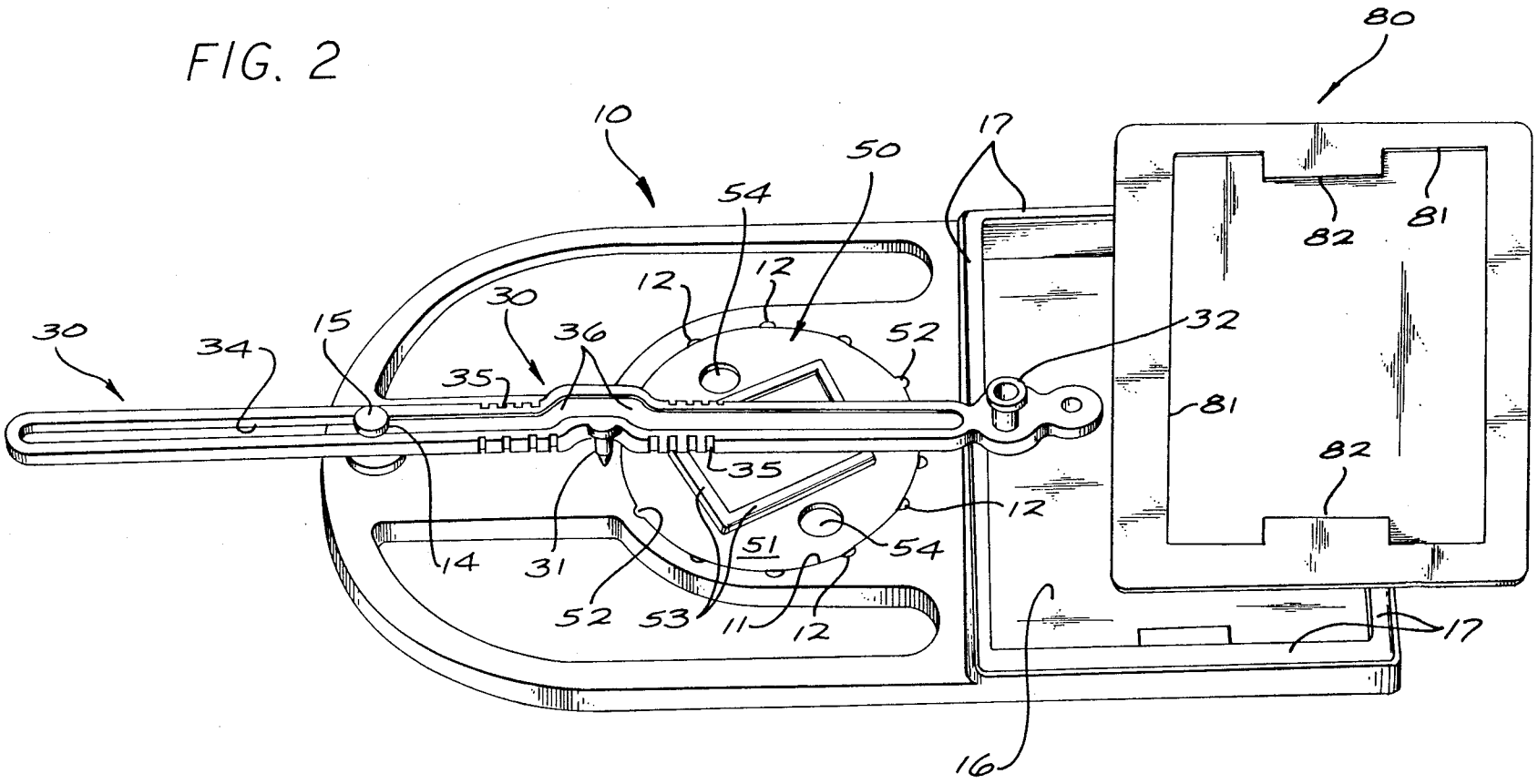
FIG. 2 is a partially exploded perspective view of the FIG. 1 embodiment.

As shown in FIGS. 1 and 2, the apparatus has a base 10, a tracing arm 30 holding a drawing implement 33, a rotatably mounted platform 50 carrying a retainer 70 for a photograph 77, and an easel 80 for holding a drawing medium 88. The easel 80 also serves as a cover for a supply compartment 16 (FIG. 2).

Formed at one end of the base 10 is a rectangular ridge 17 that defines the periphery of the supply compartment 16 and also functions as a support for the easel 80. Formed at the opposite end of the base 10 is an upstanding pivot pin 14, terminated by a top flange 15.

Formed in the central expanse of the base 10, intermediate between easel support ridge 17 and the pivot pin 14, is a generally circular recess 11 that receives the picture-supporting platform 50. Formed equidistantly about the periphery of this recess 11 in the base are twelve small radial indentations 12, which serve as detent elements to stabilize the platform orientation.

The tracing arm 30 is the only part of the apparatus which is ordinarily moved in the course of tracing a picture. The arm 30 has a stylus 31 near its center, a drawing-implement holder 32 for a pen or other implement 33, and a longitudinal slot or track 34. The arm also advantageously is formed with finger-grip ribs 35 near its center, and a slight dogleg or offset 36 in the area of the stylus—to permit a better view of the stylus itself during use.

The easel 80 has a very shallow recess 81 for receiving a piece of paper or other drawing medium 88. Integrally formed at two ends of the easel 80 are clips 82 for keeping the paper in place.

Figure 3:
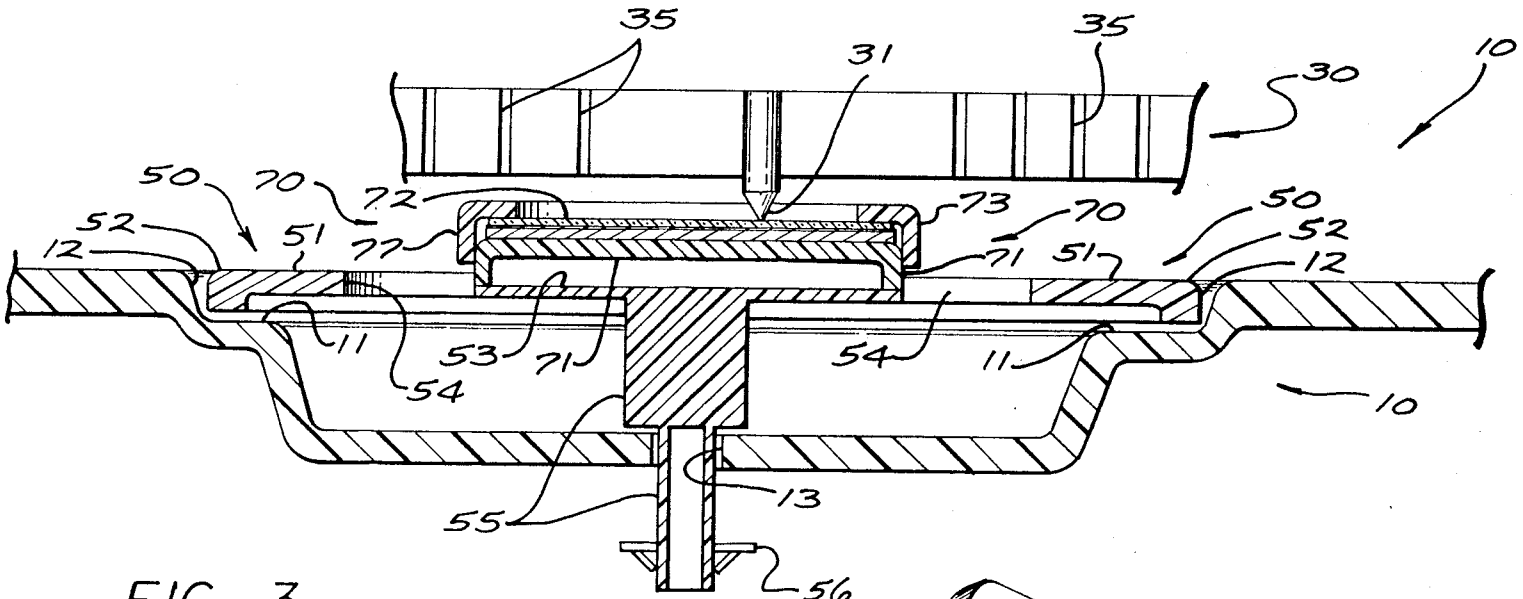
FIG. 3 is a partial longitudinal section of the same embodiment, with the retainer in place on the platform.

The platform 50 has a generally circular deck 51, two radial nubs or bosses 52 integrally formed at diametrically opposite points on the periphery of the deck 51, and a downward-extending central shaft 55 (FIG. 3). A recess 53 is formed in the upper surface of the platform 50, to receive the photo retainer 70; and a pair of finger-grip apertures 54 is formed adjacent to the photo-retainer recess 53.

The bosses 52 serve as mating detent elements, engaging any selected diametral two of the twelve indentations 12 in the periphery of the recess 11 in the base to stabilize the platform 50 against rotation. The particular two indentations 12 selected by the user for engagement with the bosses 52 determine the orientation of the platform 50, and thereby the photo 77.

For discussion of this apparatus, a convenient reference line is the central axis of the system—that is, the centerline passing through the pivot pin 14, the platform shaft 55, and the center of the easel 80. Thus the rotation of the platform 50 to align the bosses 52 with a particular two indentations 12 determines the orientation of the photograph 77 relative to the centerline of the system.

The platform shaft 55 protrudes through a hole 13 (FIG. 3) in the bottom of the recess 11 in the base, and below the base is gripped by a sheet-metal push-nut 56 to hold the platform 50 to the base 10. Sufficient free length of shaft 55 is provided, however, so that the platform 50 can be lifted by the finger-grip apertures 54 upward out of the recess 11 in the base. In this way the user can disengage the detent bosses 52 from their mating indentations 12, and thereby reorient the platform 50.

The photo retainer 70 includes a pedestal section 71, on which a photograph 77 is placed for tracing. The bottom of the pedestal 71 fits closely into the recess 53 in the deck of the rotary platform 50.

The retainer also includes a transparent sheet 72 for protecting the picture from the stylus 31, and an edge frame 73 that retains the photo 77 and protective sheet 72 in place on the pedestal 71. The edge frame 73 fits the pedestal 71 tightly or at least closely, to help hold the assembly together.

Figure 4:
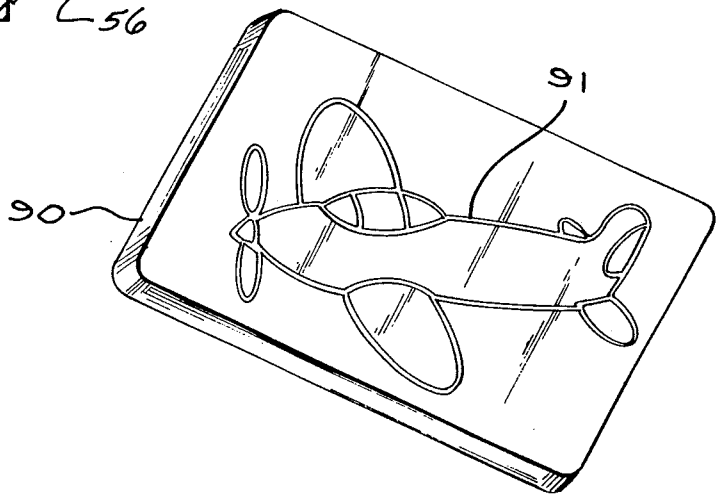
FIG. 4 is a perspective view of a silhouette tracing template for optional use instead of the retainer.

I prefer to provide also as part of the apparatus several silhouette templates 90 (FIG. 4) that have the same external shape and dimensions as the pedestal 71. Formed in the upper surface of each silhouette template 90, however, is a stylus-guiding groove 91.

The guide groove 91 is laid out on the surface of the template 90 in a familiar shape such as a clown, an animal or a vehicle. These grooves are easier to follow with the stylus than the flat surface of a photograph, and so allow the apparatus to be used by children who are relatively young or have otherwise developed relatively little dexterity or hand-to-eye coordination.

In operation of the apparatus, the tracing arm 30 is positioned as shown in FIGS. 1 and 2 with the pivot pin 14 of the base 10 passing through the slot or track 34. The arm is retained in position loosely by the flange 15 at the top of the pivot pin 14; however, the arm structure in the area of the slot or track 34 is flexible, and the tracing arm 30 can be removed from the pivot pin if desired.

Longitudinal motion of the tracing arm—that is, translation parallel to the track 34—naturally moves all portions of the arm by equal distances. In particular the pen 33 moves the same distance as the stylus 31, thus producing no enlargement of the tracing motion.

Considering the pivot pin as the center of a coordinate system, such longitudinal motion is seen as a radial component of motion of the tracing arm. Hence in summary, as mentioned in an earlier section of this document, radial components of tracing motion produce no enlargement.

Any other motion of the tracing arm, however, requires rotation of the arm about the pivot pin. Such rotation naturally entails larger excursions at greater distances (i.e., radii) from the pivot. Hence, with the effective radius of the implement holder roughly twice that of the stylus, these rotary components of motion produce pen excursions roughly double the stylus excursions.

Rotary components of tracing motion thus produce literal enlargement—that is, enlargement by a factor greater than one. Reversing the geometry as by reversing the stylus and pen positions would result in reduction—that is, "enlargement" by a factor smaller than one.

By selecting the dimensions of the photo retainer 70, easel 80 and tracing arm 30 so that the overall range of angular rotation of the arm is considerably less than about sixty degrees—or less than about thirty degrees in either direction from the system centerline—the enlargement scheme is made to appear somewhat simpler. Rather than appearing as nonenlarging in any radial direction and enlarging in a circumferential or rotary direction, the system appears simply as nonenlarging along a rectilinear axis parallel to the system centerline and enlarging along a second rectilinear axis perpendicular to the centerline.

Thus as illustrated in FIG. 1 the fore-and-aft pen excursions ar exaggerated relative to the longitudinal (left-and-right) excursions. The shape of the image that appears in the tracing is thus distorted in relation to the shape of the traced original picture.

As examples of dimensions that can be employed to provide this simplifying effect, the easel can be roughly eight inches tall (i.e., fore-to-aft), and the distance from the pivot pin to the right edge of the easel roughly sixteen inches. These dimensions correspond to an overall angular range of tracing-arm operation of approximately twenty-eight degrees, or only fourteen degrees in either direction from the system centerline.

Similarly, the photo retainer can be roughly three and a half inches tall, and the distance from the pivot pin to the right edge of the retainer roughly seven and a half inches. These dimensions correspond to an overall angular range of about twenty-six degrees, or just thirteen degrees either way from the centerline.

At thirteen to fourteen degrees half-range, the displacement of the enlargement axis introduced by curvature of that axis is less than three percent of the radius (that is, of the distance from the pivot-pin 14 to the stylus 321 or pen 33). Such a small curvature-induced error is imperceptible. Allowing half-range values as high as thirty degrees restrains the curvature-induced displacement to about one-eighth, or under thirteen percent, of the radius—still not readily noticeable.

By orienting the lateral dimension (that is, the side-to-side direction) of an original picture either perpendicular or parallel to the system centerline, the distortion may be used to either fatten or narrow, respectively, objects in the tracing relative to objects of the original image. These effects produce simple but amusing changes in the character of the object or character portrayed.

By choosing orientations intermediate between the perpendicular and parallel, a user produces oblique distortion—and thereby effects that can be more subtle and more interesting. The fixed detents 12, 52 are helpful in guiding small children to try these various orientations and to enjoy the corresponding effects.

It will be understood that the foregoing disclosure is intended to be merely exemplary, and not to limit the scope of the invention—which is to be determined by reference to the appended claims.

I claim:

1. An amusement apparatus for use with a drawing medium and drawing implement to draw a distorted caricature of an original picture by tracing of the original picture; said apparatus comprising:

a base;

a platform, supported from the base for rotation about a platform-rotation axis, for carrying such an original picture;

a drawing easel, supported from the base, for holding such drawing medium;

a drawing-implement arm having:

at one location along the arm, a motion-imparting stylus disposed generally adjacent to the platform for manual manipulation by a user to trace such original picture when in place on the platform.

at another location along the arm, a drawing-implement holder disposed generally adjacent to the easel for holding such drawing implement for marking on such medium when such medium is in place on the easel, and at a third location along the arm, a longitudinal track;

means, supported from the base, for defining an arm-pivot axis fixed relative to the base, and for engaging the track so that motions of the stylus are resolved into radial and rotary components of motion relative to the arm-pivot axis;

said radial components of motion of the stylus being produced by relative sliding motion of the track with respect to the arm-pivot axis means, and in turn producing substantially equal radial components of motion of the drawing-implement holder; and said rotary components of motion of the stylus producing corresponding rotary components of motion of the drawing-implement holder, with an enlargement factor determined by the relative distances of the stylus and the drawing-implement holder from the arm-pivot axis;

whereby said apparatus produces such a caricature of the original pictured that is distorted by being enlarged with respect to only the rotary components of tracing motion;

a retainer, carried on the platform, for retaining such an original picture; and manually operable means for positioning the platform, and the retainer and original picture thereon, in any user-selected one of a multiplicity of angular orientations;

whereby the user can select and set a desired particular angular orientation of the original picture relative to said radial components of motion of the stylus, and thereby select a desired relationship between directions in which enlargement occurs and features of the original picture; and wherein:

the positioning means comprise manually releasable detent means for holding the platform against rotation;

the platform is a generally circular disc having a downward-extending central shaft;

the base has a generally circular recess to receive the platform, and a central hole within the recess to receive the shaft;

the manually releasable detent means comprise first detent elements formed in the platform, and second detent elements formed along the recess for engaging the first detent elements;

a bottom end of the shaft protrudes below the base and is there captured by a fastener;

the fastener is positioned sufficiently far downward along the shaft to permit the platform and shaft to be raised out of the recess, to disengage the first detent elements from the second detent elements; and finger-grip orifices are formed in the platform disc;

whereby the user can repetitively and selectively release the holding of the platform in a particular orientation and restore the holding of the platform in another particular orientation, by inserting fingers through the orifices to grip the platform disc, raising the disc to disengage the detent elements, rotating the disc to differently align the detent elements, and lowering the disc to reengage the detent elements.

2. The amusement apparatus of claim 1, wherein:

the retainer comprises a pedestal for supporting the original picture, a transparent sheet for placement over the original picture to protect the picture from the stylus, and an edge frame that fits over the pedestal and transparent sheet for holding the sheet or the original picture, or both, to the pedestal; and the platform is formed to engage the retainer while the edge frame holds the sheet or original picture, or both, to the pedestal.

3. The amusement apparatus of claim 1, wherein:

the retainer has a centerline passing through the arm-pivot axis;

the size of the retainer, in relation to the distance between the retainer and the arm-pivot axis, limits the rotary components of motion of the stylus to an overall range of substantially less than thirty degrees in either direction from the centerline so that the motions of the stylus are resolved very approximately into rectilinear components that are respectively parallel and perpendicular to the centerline;

whereby the user can orient features of the original picture in any desired direction relative to a roughly rectilinear axis along which enlargement occurs.

4. The amusement apparatus of claim 1, wherein:

the easel has a centerline passing through the arm-pivot axis;

the size of the easel, in relation to the distance between the easel and the arm-pivot axis, limits the rotary components of motion of the drawing-implement holder on the easel to an overall range of substantially less than thirty degrees in either direction from the centerline so that the motions of the drawing-implement holder are resolved very approximately into rectilinear components that are respectively parallel and perpendicular to the centerline;

whereby the user can orient features of the caricature in any desired direction relative to a roughly rectilinear axis along which enlargement occurs.

5. The amusement of claim 1, wherein:

the drawing-implement holding is near one end of the drawing-implement arm;

the track is near an opposite end of the drawing-implement arm; and the stylus is intermediate along the drawing-implement arm between the holder and the track;

whereby the enlargement is always by a factor greater than unity.

6. The amusement apparatus of claim 1, further comprising:

engagement means formed in the platform to engage the retainer; and a plurality of individual silhouette templates, each selectably engageable with the platform engagement means in place of the retainer, and each engageable with the stylus for easy tracing of the corresponding silhouette;

whereby the user of the apparatus can select, at the user's preference, either:

use of the apparatus to produce a distorted caricature of such an original picture, by visually guided tracing of such picture, or use of the apparatus to produce a distorted caricature of any one of the silhouettes, by template-engagement-guided tracing of the silhouette.

7. The apparatus of claim 1, further comprising:

such picture, in the form of a photographic print.

8. An amusement apparatus for use with a drawing medium and drawing implement to draw a distorted caricature of an original picture by tracing of the original picture; said apparatus comprising:

a base;

a platform, supported from the base for rotation about a platform-rotation axis, for carrying such an original picture;

a drawing easel, supported from the base, for holding such drawing medium;

a drawing-implement arm having:

at one location along the arm, a motion-imparting stylus disposed generally adjacent to the platform for manual manipulation by a user to trace such original picture when in place on the platform.

at another location along the arm, a drawing-implement holder disposed generally adjacent to the easel for holding such drawing implement for marking on such medium when such medium is in place on the easel, and at a third location along the arm, a longitudinal track;

means, supported from the base, for defining an arm-pivot axis fixed relative to the base, and for engaging the track so that motions of the stylus are resolved into radial and rotary components of motion relative to the arm-pivot axis;

said radial components of motion of the stylus being produced by relative sliding motion of the track with respect to the arm-pivot axis means and in turn producing substantially equal radial components of motion of the drawing-implement holder; and said rotary components of motion of the stylus producing corresponding rotary components of motion of the drawing-implement holder, with an enlargement factor determined by the relative distances of the stylus and the drawing-implement holder from the arm-pivot axis;

whereby said apparatus produces such a caricature of the original picture that is distorted by being enlarged with respect to only the rotary components of tracing motion;

a retainer, carried on the platform, for retaining such an original picture; and manually operable means for positioning the platform, and the retainer and original picture thereon, in any user-selected one of a multiplicity of angular orientations;

whereby the user can select and set a desired particular angular orientation of the original picture relative to said radial components of motion of the stylus, and thereby select a desired relationship between directions in which enlargement occurs and features of the original picture; and wherein:

the retainer comprises a pedestal for supporting the original picture, a transparent sheet for placement over the original picture to protect the picture from the stylus, and an edge frame and fits over the pedestal and transparent sheet for holding the sheet or the original picture, or both, to the pedestal; and the platform is formed to engage the retainer while the edge frame holds the sheet or original picture, or both, to the pedestal.

* * * * *